United States Patent [19]

Schuil

[11] Patent Number: 4,817,793

[45] Date of Patent: Apr. 4, 1989

[54] PROTECTIVE PACKAGE FOR A DISPLAY TUBE WINDOW

[75] Inventor: Roelof E. Schuil, Eindhoven, Netherlands

[73] Assignee: U.S. Philips Corporation, New York, N.Y.

[21] Appl. No.: 88,749

[22] Filed: Aug. 24, 1987

[30] Foreign Application Priority Data

Aug. 27, 1986 [NL] Netherlands ..... 8602173

[51] Int. Cl.[4] ..... B65D 69/00

[52] U.S. Cl. ..... 206/328; 220/2.1 A; 313/495

[58] Field of Search ..... 206/328, 418, 454, 526; 220/2.1 R, 2.1 A, 2.2, 2.3 R, 2.3 A; 313/422, 495–497

[56] References Cited

U.S. PATENT DOCUMENTS

| | | | |
|---|---|---|---|
| 2,756,892 | 7/1956 | Bleuze et al. | 220/2.3 A |
| 2,992,747 | 7/1961 | Atkeson | 206/454 |
| 3,037,834 | 6/1962 | Lederer et al. | 220/2.1 A |
| 3,136,441 | 6/1964 | Day, Jr. et al. | 220/2.1 A |
| 3,497,746 | 2/1970 | Duistermaat et al. | 220/2.1 A |
| 3,555,663 | 1/1971 | Forman | 220/2.3 R |
| 3,947,620 | 3/1976 | Plant et al. | 220/2.3 A |
| 4,127,683 | 11/1978 | Flemmer et al. | 206/454 |
| 4,205,252 | 5/1980 | Sinclair et al. | 313/422 |
| 4,311,239 | 1/1982 | Schlicker | 206/454 |

FOREIGN PATENT DOCUMENTS

| | | | |
|---|---|---|---|
| 2157567 | 6/1972 | Fed. Rep. of Germany | 206/454 |
| 1149498 | 4/1969 | United Kingdom | 206/454 |

*Primary Examiner*—Jimmy G. Foster
*Attorney, Agent, or Firm*—John C. Fox

[57] ABSTRACT

The invention relates to a protective package for a display window for a display tube, which display window has an upstanding edge. A cover such as a second display window is laid on a synthetic resin ring located on the upstanding edge, and the space which is enclosed by the display window 2 and the cover is evacuated.

3 Claims, 1 Drawing Sheet

PROTECTIVE PACKAGE FOR A DISPLAY TUBE WINDOW

BACKGROUND OF THE INVENTION

The invention relates to a protective package of a display window for a display tube, which display window comprises an upstanding edge.

Such a package is known from French Patent Specification No, 2,168,646. The package described in said Specification comprises a device which is provided around the side of the display window remote from the upstanding edge. This device is made of a thermoplastic material.

When a display window is complete, i.e. ready for use but cannot yet be assembled in a display tube, the display window should be stored and/or transported with special precautions. For example rusting of the metal components such as the shadow mask, of the complete display window should be avoided. In the package known from French Patent Specification No. 2,168,646, rust formation on metal components of a complete display window may occur during the storage and/or the transport of the display window. Moreover, the known package can become damaged during transport as a result of which the display window can be damaged. In addition, the use of a thermoplastic material in the known package is costly.

It is an obejct of the invention to provide a cheap package for a display window which will enable the display window to be transported and stored with sufficient safety and in which, in the case of a complete display window, the components of the display window will experience substantially no detrimental influences.

SUMMARY OF THE INVENTION

A protective package for a display window for a display tube, which display window comprises an upstanding edge, is therefore characterized in that a cover is provided on the upstanding edge of, and extending over, the display window and a ring of a synthetic resin material is present between the cover and the upstanding edge of the display window, whereby the space enclosed by the display window and the cover being evacuated. Since the space is evacuated, the components of a complete display window are protected from damage and/or corrosion during storage and/or transport.

A preferred embodiment of a package according to the invention is characterized in that the cover is a second display window having an upstanding edge, the upstanding edges of the display windows being situated substantially opposite each other and the ring of synthetic resin material being present between the upstanding edges. By using another display window as a cover, a very simple and cheap package with few components is obtained.

Another embodiment of a package according to the invention is characterized in that the ring of a synthetic resin material comprises an upright edge. As a result of said upright edge the cover cannot slide off the display window and the stability of the package is increased.

A still further embodiment of a package according to the invention is characterized in that the synthetic resin ring has a lug to facilitate the removal of the synthetic resin ring from between the cover and the display window, so that the vacuum which prevails in the space enclosed by the cover and the display window can be destroyed. The display window and the cover can then be separated from each other in a simple manner, making the display window available for use in a display tube.

BRIEF DESCRIPTION OF THE DRAWINGS

A few embodiments of the invention will now be described in greater detail, by way of example, with reference to the drawing, in which.

DESCRIPTION OF THE PREFERRED EMBODIMENTS

Figure 1:
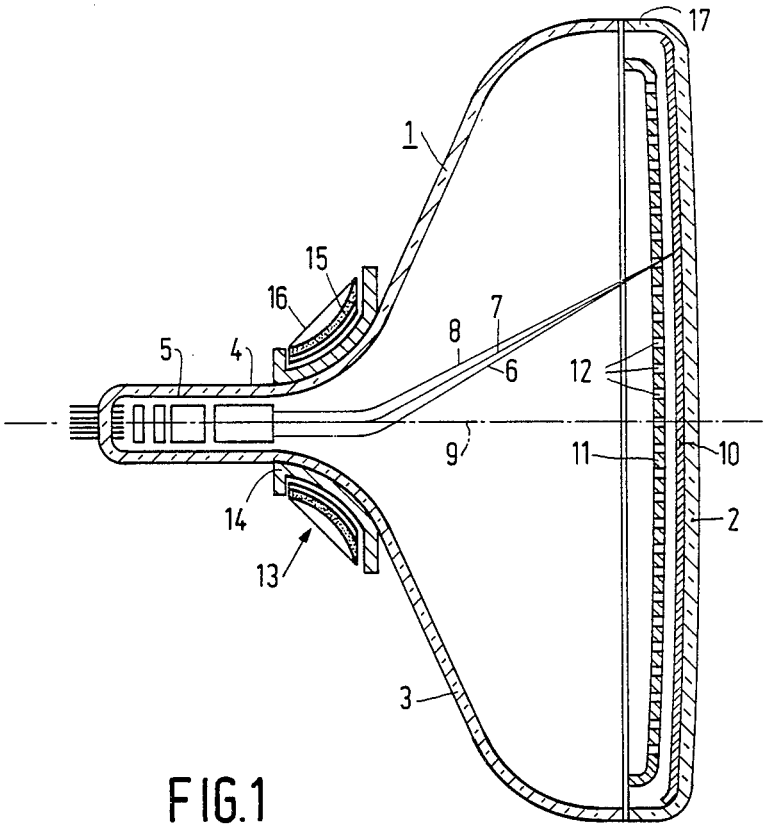
FIG. 1 is a diagrammatic longitudinal sectional view through a conventional display tube.

FIG. 1 is a diagrammatic longitudinal sectional view through a conventional display tube. It is a colour display tube of the "in-line" type having a glass envelope 1 which is composed of a display window 2, a cone 3 and a neck 4. In said neck 4 an integrated electron gun system is provided which generates three electron beams 6, 7 and 8 which, prior to deflection, are situated with their axes in one plane, the so-called "in-line" plane. The axis of the central electron beam 7 coincides with the tube axis. The display window 2 which comprises the upstanding edge 17 is provided on its inside with a large number of triplets of phosphor elements. The elements may consists of lines or dots. Each triplet comprises an element which consist of a blue-luminescing phosphor, an element consisting of a green-luminescing phosphor, and an element consisting of a red-luminescing phosphor. All triplets together constitute the display screen 10. The phosphor lines are substantially perpendicular to the in-line plane. In front of the display screen 10 a shadow mask 11 is positioned, the mask having a very great number of apertures. Electron beams 6, 7 and 8 pass through these apertures and each beam impinges only on phosphor elements of one colour. The three electron beams which are situated in the in-line plane are deflected by a system of deflection coils 13 which comprises a line deflection coil 14, a yoke ring 15 and a field deflection coil 16.

In general, the display window and the cone are manufactured separately and bonded together at a later stage. In the period between the manufacture of the display window and the bonding of the display window to the cone the display window should be stored and transported without the display window being damaged. Such damage could include not only mechanical damage, such as scratches or dents in the delicate mask and screen, but also contamination damage, such as dust particles and corrosion damage to the metal components, such as the mask, mask mounting structures and an evaporated aluminium layer on the back of the screen.

Figure 2:
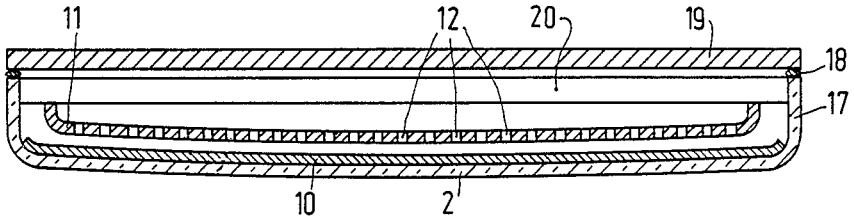
FIG. 2 is a diagrammatical longitudinal sectional view showing a package for a display window according to the invention.

FIG. 2 shows diagrammatically an embodiment of a package of a display window according to the invention. This display window 2 comprises an upstanding edge 17. On the upstanding edge 17 a flat cover plate 19 is provided. Between the edge 17 and the cover plate 19 a synthetic resin ring 18, for example manufactured rubber, is present. The cover plate 19 and the display window 2 together enclose a space 20 which is evacuated to form a vacuum seal and protect the components of the complete display window 2, for example the display screen and the shadow mask 11, against damage, for example from corrosion, during storage and/or transport. Moreover, as a result of the compact package a handable assembly is obtained. Evacuation of space 20 is obtained by placing the display window 2 and the cover plate 19 in an evacuation vessel. When the evacuation vessel is evacuated the space 20 also becomes evacuated.

Figure 3:
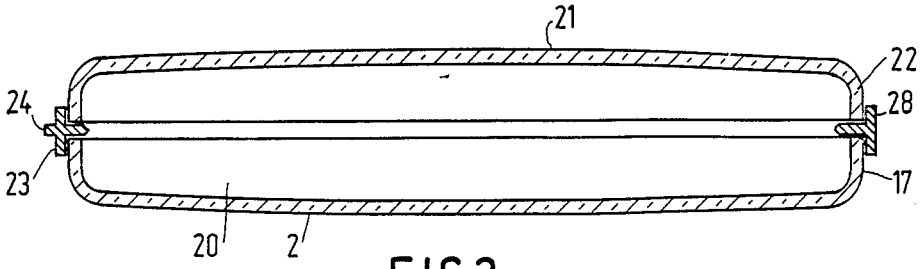
FIG. 3 is a diagrammatical view similar to that of FIG. 2 showing a preferred form of a package for a display window according to the invention.

FIG. 3 shows a preferred embodiment of the invention in which another display window 21 is used as a cover, thereby avoiding the need to purchase separate cover plates, and enabling the sharing of a single sealing ring by two display windows. The upstanding edges 17 and 22 of the display windows 2 and 21 are laid one on top of the other, with a synthetic resin ring 28 being present between the upstanding edges 17 and 22. Synthetic resin ring 28 comprises an upright edge 23 to prevent the display windows from slipping off each other. The display windows 2 and 21 can be separated from one antoher by breaking the seal. This may take place by means of pulling on a lug 24 on the synthetic resin ring 18. The vacuum in the space 20 is destroyed and the display windows can be removed from each other easily.

It will be obvious that a package of a display window according to the invention is not restricted to the examples described but that many variations are possible to those skilled in the art without departing from the scope of the invention. For example, the shape of the cover may be chosen to enable stacking of several display window packages in a simple and stable manner.

I claim:

1. A temporary protective assembly for a pair of display windows of a display tube, the display windows each comprising an upright edge, the right edges of the display windows being situated substantially opposite each other, a ring of synthetic material present between the edges, the assembly thereby enclosing a space between the display windows, the space being evacuated, whereby the assembly provides protection for the display windows during transport and/or storage, prior to the permanent assembly of the display windows into a display tube.

2. A package as claimed in claim 1, characterized in that the synthetic resin ring comprises an upright edge.

3. A package as claimed in claim 1, characterized in that the synthetic resin ring comprises a lug for pulling out the synthetic resin ring from between the display window and the cover.

* * * * *